US007152951B2

(12) United States Patent
Maher et al.

(10) Patent No.: US 7,152,951 B2
(45) Date of Patent: Dec. 26, 2006

(54) HIGH RESOLUTION INK JET PRINTHEAD

(75) Inventors: Colin G. Maher, Lexington, KY (US); James H. Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 319 days.

(21) Appl. No.: 10/775,874

(22) Filed: Feb. 10, 2004

(65) Prior Publication Data

US 2005/0174385 A1 Aug. 11, 2005

(51) Int. Cl.
*B41J 2/14* (2006.01)
*B41J 2/16* (2006.01)
*B41J 2/05* (2006.01)

(52) U.S. Cl. ..... 347/47; 347/62; 347/65

(58) Field of Classification Search ..... 347/20, 347/54, 56, 61–62, 65
See application file for complete search history.

(56) References Cited

U.S. PATENT DOCUMENTS 3,861,598 A * 1/1975 Fleischer ..... 239/543
5,291,226 A 3/1994 Schantz et al.
5,408,738 A 4/1995 Schantz et al.
5,548,894 A 8/1996 Muto
5,559,543 A 9/1996 Komuro
5,608,436 A 3/1997 Baughman et al.
5,648,805 A 7/1997 Keefe et al.
5,697,144 A * 12/1997 Mitani et al. ..... 29/611
5,808,640 A * 9/1998 Bhaskar et al. ..... 347/58
5,946,012 A 8/1999 Courian et al.
5,948,290 A 9/1999 Yamamoto et al.
6,045,214 A 4/2000 Murthy et al.
6,106,096 A * 8/2000 Komplin et al. ..... 347/20
6,183,078 B1 2/2001 Pietrzyk et al.
6,280,021 B1 8/2001 Wu et al.
6,283,584 B1 * 9/2001 Powers et al. ..... 347/65
6,409,315 B1 6/2002 Komuro
6,447,088 B1 9/2002 Tachihara et al.
6,478,410 B1 11/2002 Prasad et al.
6,523,935 B1 2/2003 Torgerson et al.
6,601,945 B1 8/2003 Kitakami
6,957,886 B1 * 10/2005 Alfekri et al. ..... 347/102
2003/0197756 A1 10/2003 Inoue et al.

FOREIGN PATENT DOCUMENTS

EP 0577383 1/1994

* cited by examiner

*Primary Examiner*—Vip Patel
*Assistant Examiner*—Lisa M. Solomon
(74) *Attorney, Agent, or Firm*—Luedeka, Neely & Graham

(57) ABSTRACT

A high resolution printhead for an ink jet printer. The printhead includes a semiconductor substrate containing at least one ink feed edge and a plurality of ink ejection actuators spaced a distance from the ink feed edge. Each of the ink ejection actuators has an aspect ratio ranging from about 1.5:1 to about 6:1. A nozzle plate is attached to the semiconductor substrate. The nozzle plate contains a plurality of nozzle holes, ink chambers and ink channels laser ablated in the nozzle plate corresponding to the plurality of ink ejection actuators. Adjacent nozzle holes are spaced apart with a pitch ranging from about 600 to about 1200 dpi. The distance from the ink feed edge is substantially the same for each of the ink ejection actuators.

29 Claims, 7 Drawing Sheets

HIGH RESOLUTION INK JET PRINTHEAD

FIELD OF THE INVENTION

The invention relates to ink jet printheads and in particular to ink jet printheads having increased resolution and methods for making the printheads.

BACKGROUND OF THE INVENTION

Ink jet printers continue to experience wide acceptance as economical replacements for laser printers. Such ink jet printers are typically more versatile than laser printers for some applications. As the capabilities of ink jet printers are increased to provide higher quality images at increased printing rates, printheads, which are the primary printing components of ink jet printers, continue to evolve and become more complex.

Improved print quality requires that the printheads provide an increased number of ink droplets. In order to increase the number of ink droplets from a printhead, printheads are designed to include more nozzles and corresponding ink ejection actuators. The number of nozzles and actuators for a "top shooter" or "roof shooter" printhead can be increased in several ways known to those skilled in the art. For example, in an integrated nozzle plate containing nozzle holes, ink chambers, and ink channels laser ablated in a polyimide material, adjacent nozzles and corresponding ink chambers are typically offset from one another in a direction orthogonal to the ink feed slot. Such a design results in adjacent nozzles having different fluidic characteristics such as refill times which can result in quality defects and can limit high frequency operation of the ejector actuators. The offset is primarily due to laser ablation of the nozzle plate material to form the ink chambers. With a laser ablated nozzle plate containing ink chambers and ink channels, a minimum spacing between adjacent ink chambers is required to provide sufficient chamber wall structure for the ink chambers. Hence, a larger nozzle plate and corresponding semiconductor substrate is required as the number of nozzles and actuators for the printhead is increased.

Despite the advances made in the art of ink jet printheads, there remains a need for printheads having higher resolution that can operate at higher ejection frequencies without substantially increasing the cost for producing such printheads.

SUMMARY OF THE INVENTION

With regard to the foregoing and other objects and advantages there is provided a high resolution printhead for an ink jet printer. The printhead includes a semiconductor substrate containing at least one ink feed edge and a plurality of ink ejection actuators spaced a distance from the ink feed edge. Each of the ink ejection actuators has an aspect ratio ranging from about 1.5:1 to about 6:1. A nozzle plate is attached to the semiconductor substrate by use of an adhesive or preferably an adhesive and an intermediate polymeric layer. The nozzle plate contains a plurality of nozzle holes, ink chambers and ink channels laser ablated in the nozzle plate corresponding to the plurality of ink ejection actuators. Adjacent nozzle holes are spaced apart with a pitch ranging from about 600 to about 1200 dpi. The distance from the ink feed edge is substantially the same for each of the ink ejection actuators.

In another embodiment there is provided a printhead for an ink jet printer. The printhead includes a semiconductor substrate containing at least one ink feed edge and a plurality of ink ejection actuators spaced a distance from the ink feed edge. Each of the ink ejection actuators has an aspect ratio ranging from about 1.5:1 to about 6:1. A thick film layer is attached to the semiconductor substrate. The thick film layer has formed therein a plurality of ink feed chambers and ink feed channels corresponding to the plurality of ink ejection actuators. A nozzle plate is attached to the thick film layer. The nozzle plate contains a plurality of nozzle holes laser ablated in the nozzle plate corresponding to the plurality of ink feed chambers. Adjacent nozzle holes are spaced apart with a pitch ranging from about 600 to about 2400 dpi. The distance from the ink feed edge is substantially the same for each of the ink ejection actuators.

An advantage of the invention is that it provides printheads having increased print resolution without decreasing the firing frequency and without significantly increasing the size of the printhead components. The invention also enables production of printheads having a nozzle pitch of greater than 600 dpi without the need to provide adjacent nozzles and corresponding ink chambers that are offset from one another in a direction orthogonal to the ink feed slot. Accordingly, the fluidic characteristics of each of nozzles are substantially the same.

For purposes of this invention, the term "pitch" as it is applied to nozzles or ink ejection actuators is intended to mean a center to center spacing between adjacent nozzles or ejection actuators in a direction substantially parallel with an axis aligned with a columnar nozzle array. The term "aspect ratio" as it applies to the ink ejection actuators is the ratio of the length of the actuators to the width of the actuators.

BRIEF DESCRIPTION OF THE DRAWINGS

Further advantages of the invention will become apparent by reference to the detailed description of preferred embodiments when considered in conjunction with the following drawings illustrating one or more non-limiting aspects of the invention, wherein like reference characters designate like or similar elements throughout the several drawings as follows.

DETAILED DESCRIPTION OF THE INVENTION

Figure 1:
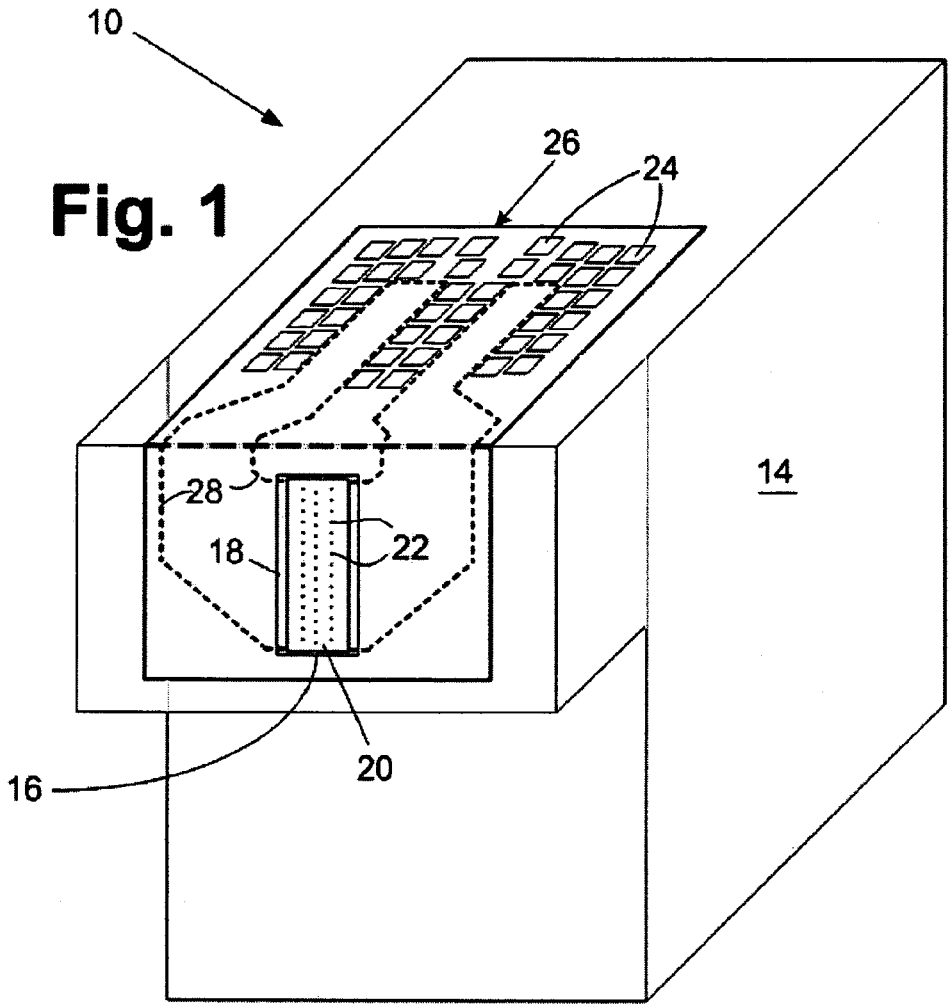
FIG. 1 is a ink jet printer cartridge, not to scale, containing a printhead according to the invention.
Figure 3:
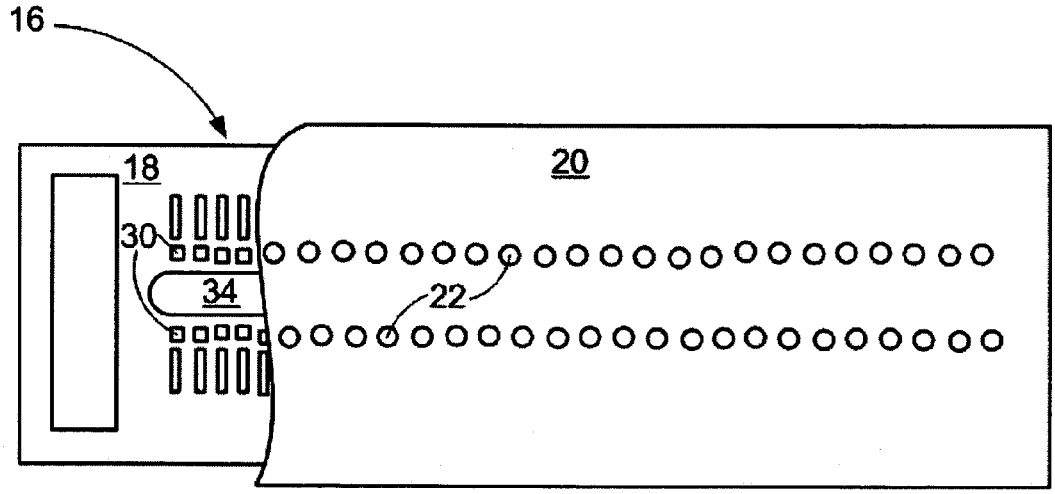
FIG. 3 is a plan view, not to scale, of a printhead containing according to the invention.
Figure 2:
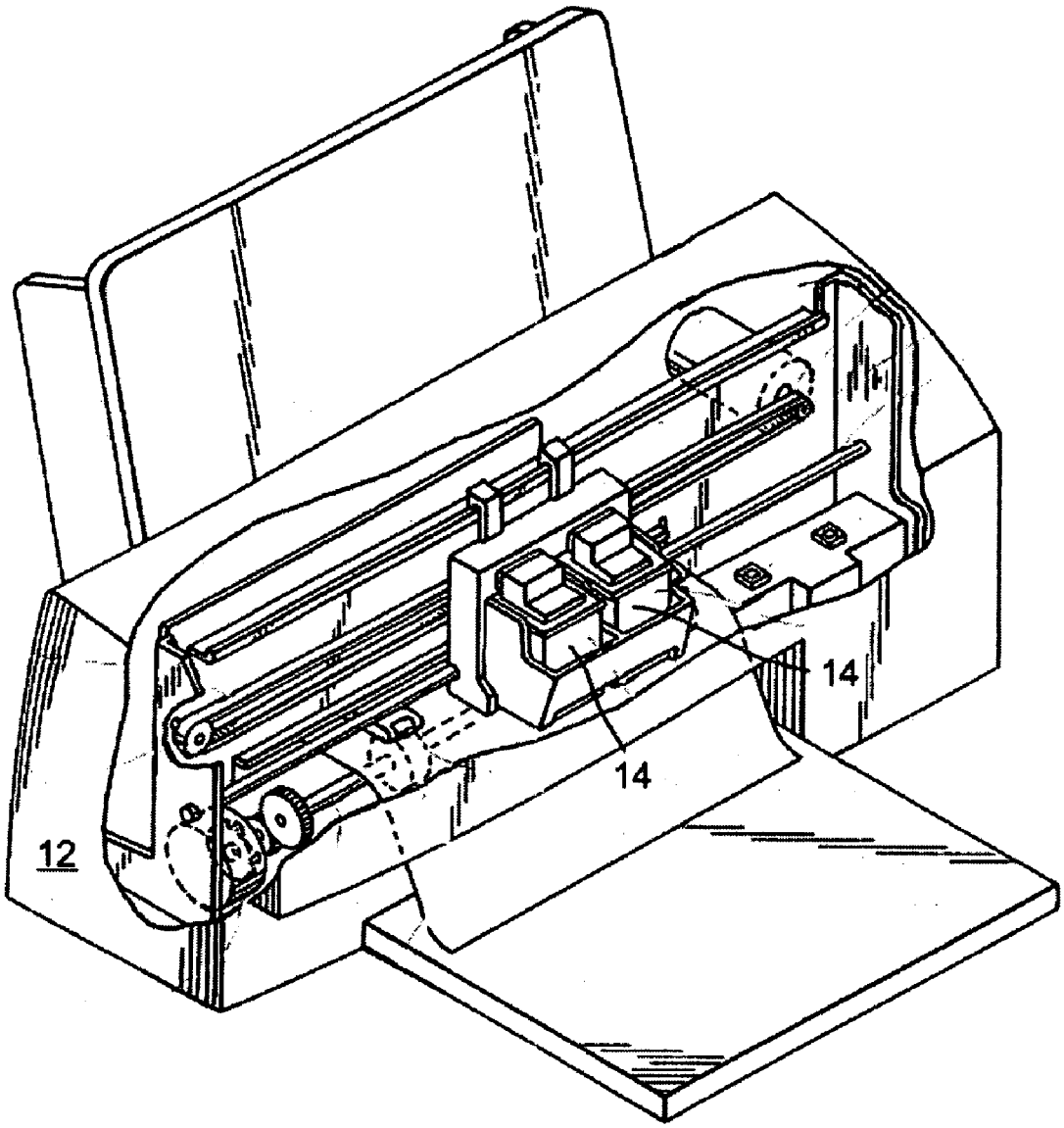
FIG. 2 is a perspective view of an ink jet printer according to the invention.

With reference to FIGS. 1–3, an ink jet printer cartridge 10 containing a printhead 16 for an ink jet printer 12 is illustrated. The cartridge 10 includes a cartridge body 14 for supplying a fluid such as ink to the printhead 16. The fluid may be contained in a storage area in the cartridge body 14 or may be supplied from a remote source to the cartridge body 14.

The printhead 16 includes a semiconductor substrate 18 and a nozzle plate 20 containing nozzle holes 22 attached to the substrate 18, or in another embodiment, attached to a thick film layer on the substrate. It is preferred that the cartridge 10 be removably attached to the ink jet printer 12. Accordingly, electrical contacts 24 are provided on a flexible circuit 26 for electrical connection to the ink jet printer 12. The flexible circuit 26 includes electrical traces 28 that are connected to the substrate 18 of the printhead 16.

Figure 4:
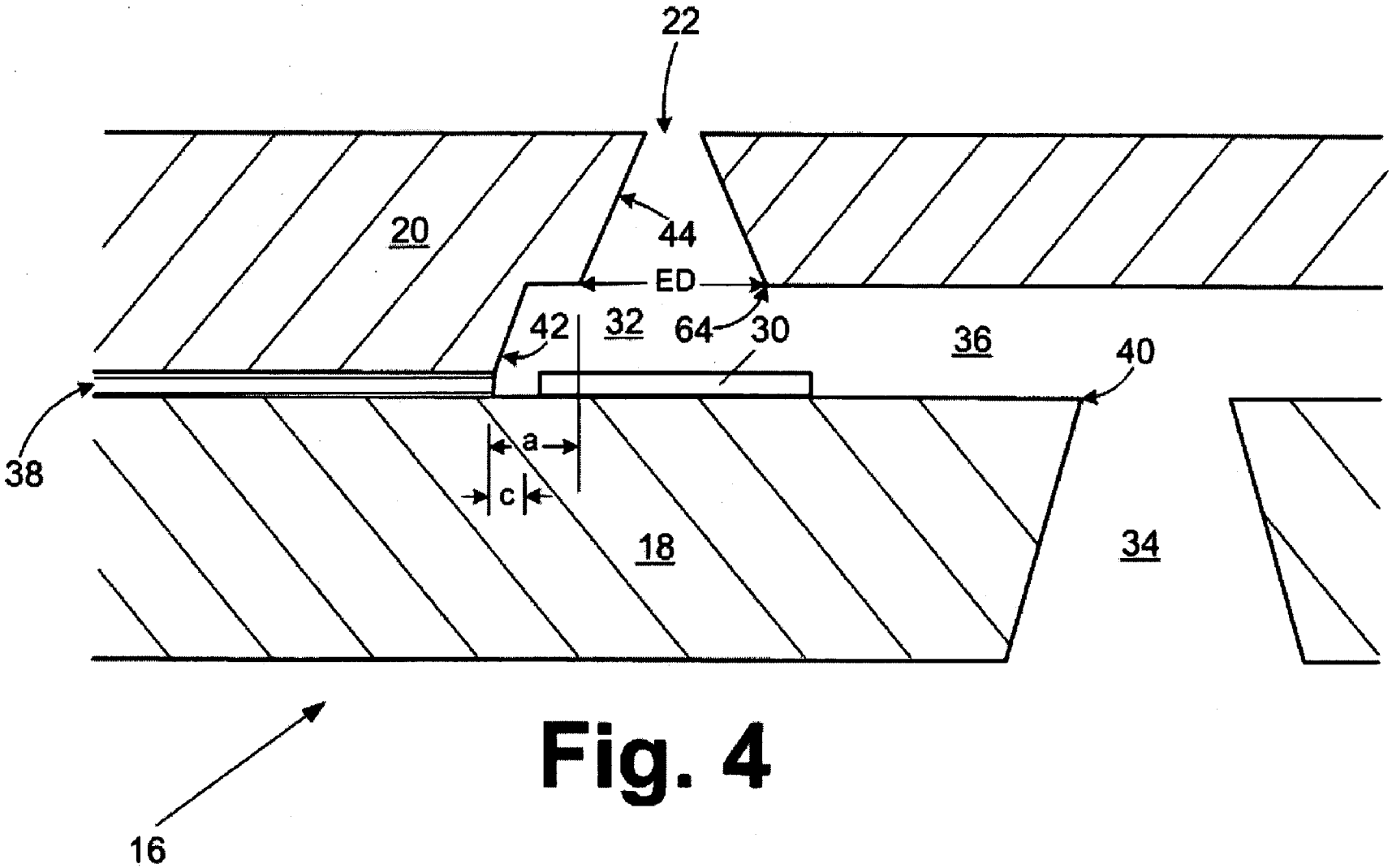
FIG. 4 is a cross-sectional view, not to scale of a portion of a printhead according to one embodiment of the invention.

An enlarged cross-sectional view, not to scale, of a portion of a printhead 16 according to one embodiment of the invention is illustrated in FIG. 4. In this embodiment, the printhead 16 contains a thermal heating element 30 for heating the fluid in a fluid chamber or ink chamber 32 formed in the nozzle plate 20 between the substrate 18 and the nozzle hole 22. However, the invention is not limited to a printhead 16 containing a thermal heating element 30. Other fluid ejection devices or ink ejection actuators, such as piezoelectric devices may also be used to provide a printhead according to the invention.

Fluid for ejection by the printhead 16 through nozzle holes 22 is preferably provided to the fluid chamber 32 through an opening or slot 34 in the substrate 18 and through a fluid channel 36 connecting the slot 34 with the fluid chamber 32. The nozzle plate 20 is preferably adhesively attached to the substrate 18 as by adhesive layer 38. In a particularly preferred embodiment, the printhead is a thermal or piezoelectric ink jet printhead. However, the invention is not intended to be limited to ink jet printheads as other fluids may be ejected with a micro-fluid ejecting device according to the invention.

Also the invention is not limited to a printhead having a fluid feed slot 34 in the substrate 18. A fluid may also be caused to flow around opposed outer edges of the substrate 18 and into the fluid channel 36 and fluid chamber 32. Accordingly, a fluid feed edge 40 is provided which may be an edge of the feed slot 34, or in the case of an edge feed configuration, an outer edge of the substrate 18.

In the embodiment illustrated in FIG. 4, the ink chamber 32 and ink channel 36 are formed in the nozzle plate 20 as by laser ablation. Laser ablation of the nozzle plate 20 is typically conducted from the ink chamber side of the nozzle plate 20. When the nozzle plate 20 is made of a polyimide material, walls 42 of the ink chamber 32 and walls 44 of the nozzle 22 have sloping or angled surfaces due to the laser ablation process.

Figure 5:
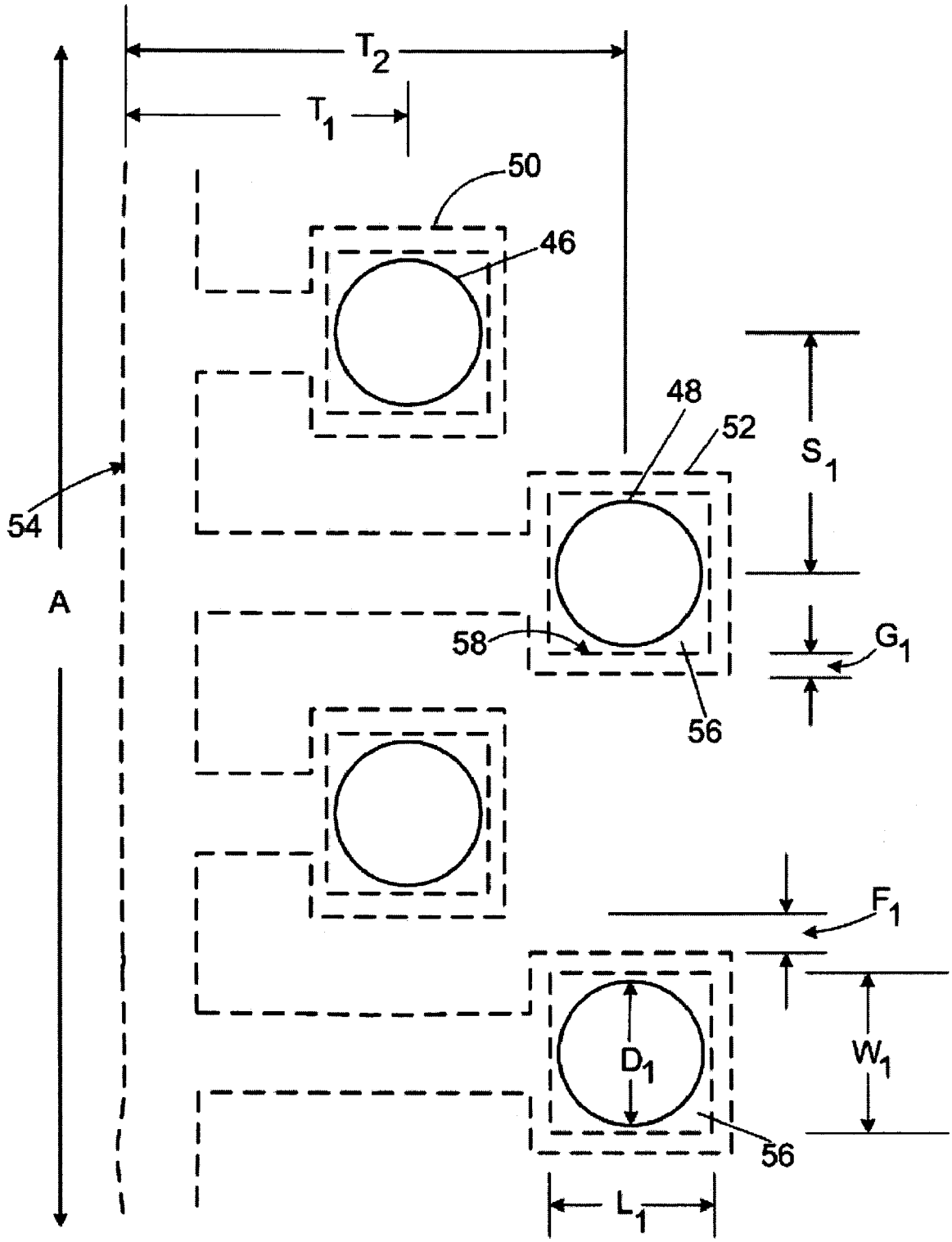
Fig. 5 Prior Art
FIG. 5 is a plan view, not to scale, of a portion of a prior art printhead.

In a prior art design of a printhead, illustrated in FIG. 5, the center to center distance $S_1$ between adjacent nozzles 46 and 48 was typically about 42 microns or more to provide a pitch of less than about 600 dpi (dots per inch) along a direction (A) parallel to an ink feed edge 54. In the prior art design illustrated in FIG. 5, nozzle holes 46 and 48 are staggered providing staggered ink chambers 50 and 52 to provide closer spacing $S_1$ between adjacent nozzles. By "staggered" it is meant that a center of nozzle 46 is a distance $T_1$ that is less than a distance $T_2$ of a center of nozzle 48 to the ink feed edge 54. In many conventional prior art designs, the aspect ratio ($L_1/W_1$) of ink ejection actuators 56 is typically less than about 1.5:1.

In order to provide a fluidic seal between adjacent ink chambers such as chambers 50 and 52, a distance $F_1$ ranging from about 7.5 to about 30 microns between adjacent ink chambers is required for a laser ablated nozzle plate considering manufacturing alignment tolerances. Also a distance $G_1$ ranging from about 0 to about 10 microns between an inside chamber wall 58 and the ink ejector 56 is typically required for a laser ablated nozzle plate. Accordingly, the pitch $S_1$ between adjacent nozzles is a function of $F_1$ and $G_1$ and the aspect ratio of the ink ejection devices.

It will be appreciated that the fluidic characteristics of nozzle 46 differ from the fluidic characteristics of nozzle 48 because nozzle 48 is farther from ink feed edge 54 than nozzle 46. It will also be appreciated that providing a substantially non-staggered array of nozzles in a laser ablated nozzle plate with a pitch of greater than 600 dpi or a spacing of less than 42 microns between adjacent nozzles 46 and 48 is desirable in order to increase print resolution and print quality with a higher ink ejection rate or firing frequency. With the design illustrated in FIG. 5, the firing frequency of the nozzles is limited by the fluid fill rate of the ink chambers 52 spaced farther from the ink feed edge 54.

Figure 6:
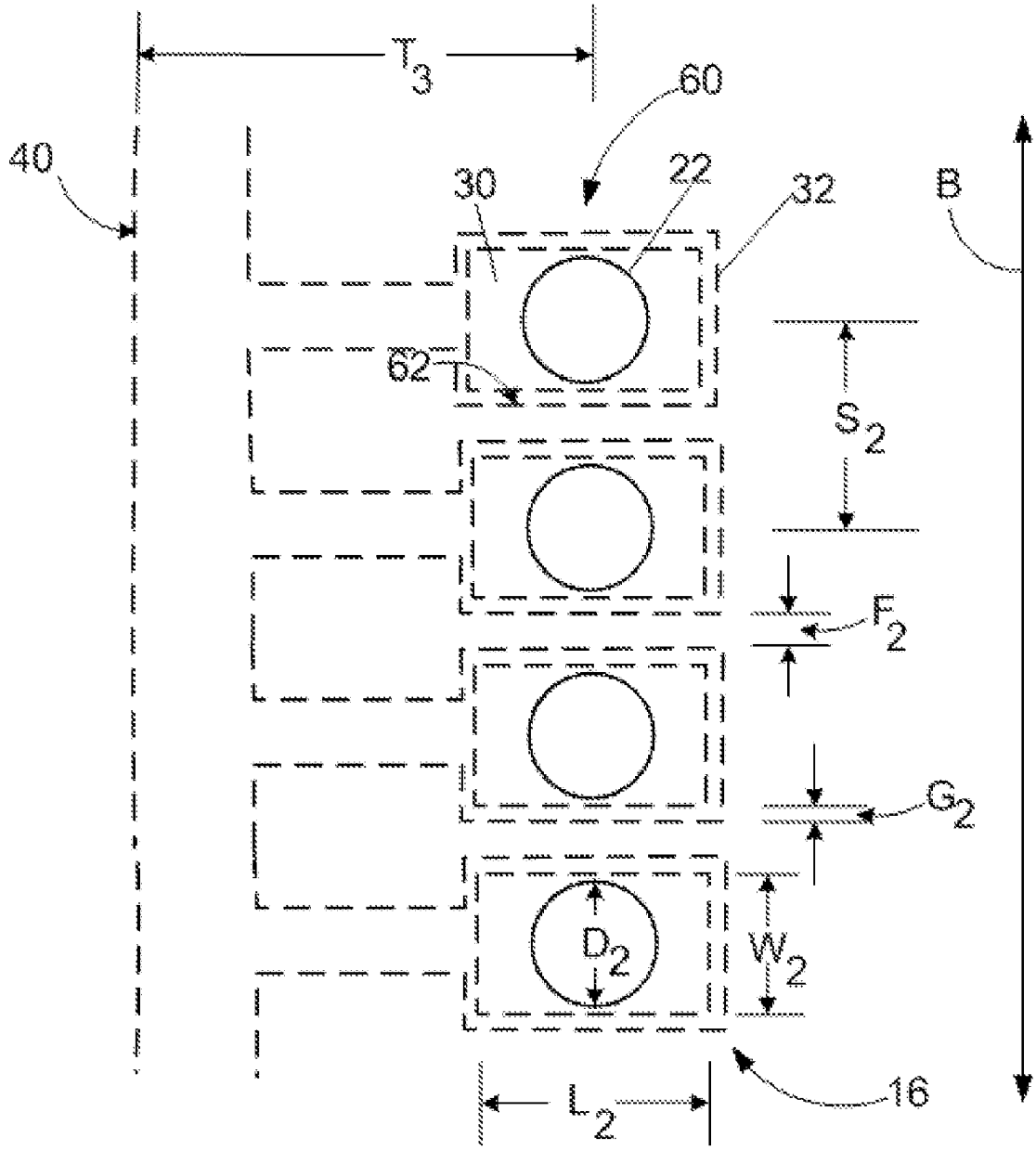
FIG. 6 is a plan view, not to scale, of a portion of a printhead according to the invention.

A portion of a printhead 16 according to one embodiment of the invention is illustrated in plan view, not to scale, in FIG. 6. According to the invention, a substantially linear array 60 of ink ejection nozzles 22 is provided. Unlike the prior art design illustrated in FIG. 5, the ink chambers 32 are spaced substantially the same distance $T_3$ from the ink feed edge 40 so that the fluidic characteristics of each nozzle 22 are substantially the same. The term "substantially the same" with respect to the distance of the ink chambers 32 from the edge means that the difference in distance from the chambers 32 in each column of chambers 32 is less than or equal to a length $L_2$ (FIG. 6) of the ink ejection devices 30. In a preferred embodiment $T_3$ preferably ranges from about 20 to about 90 microns. Also unlike the prior art design, the center to center spacing $S_2$ between adjacent nozzles 22 is preferably less than 42 microns providing a pitch of greater than about 600 dpi up to about 1200 dpi for ablated ink chambers and up to about 2400 dpi for photodeveloped ink chambers along a direction B of the linear array 60 of nozzles. In a preferred embodiment $S_2$ preferably ranges from less than 42 microns to about 10.5 microns.

As described above, there is a minimum distance $F_2$ between adjacent ink chambers for a laser ablated nozzle plate to provide sufficient chamber wall structures for fluidic sealing between adjacent ink chambers. Distance $F_2$ preferably ranges from about 6 to about 30 microns. Also, alignment tolerances between an inside chamber wall 62 and ink ejection device 30 require a spacing of $G_2$ which preferably ranges from about 0 to about 10 microns. This is particularly true for an alignment tolerance (NA) between the chamber wall 62 and the ink ejection device 30 of about 9 microns. In a laser ablated nozzle plate containing laser ablated ink chambers 32 and ink channels, $G_1 \geqq G_2$ and $F_1 = F_2$. In another embodiment, described below, $G_1 \geqq G_2$ and $F_{1 \geqq F2}$.

In order to provide a closer spacing between adjacent nozzles 22 sufficient to increase the pitch to greater than about 600 dpi, the aspect ratio of the ink ejection devices 30 is selected such that the aspect ratio ($L_2/W_2$) ranges from about 1.5:1 to about 6:1, preferably from about 2:1 to about 4.5:1. Such aspect ratio enables use of a heater resistor as the ink ejection device having a resistance ranging from about 80 to about 200 ohms or more with conventional heater resistor material. In this case, the nozzle 22 to chamber 32 alignment tolerance (NC) is about 2 microns.

For a laser ablated nozzle plate 20, referring to FIGS. 4 and 6, the following relationships can be used to select the center to center spacing $S_2$:

$$(2\times a)+ED+F_2=S_2 \quad (1)$$

where (a) is the distance between the bottom of the chamber wall 42 and an entrance 64 of the nozzle 22, ED is the entrance diameter at the entrance 64 of the nozzle 22, and $F_2$ is the spacing between adjacent chambers 32.

The entrance diameter (ED) of the nozzle 22 directly affects the drop size ejected by the nozzle 22 and is therefore normally fixed by product requirements. The distance (a) from the entrance 64 of the nozzle 22 to the chamber wall 42 is a function of the nozzle to chamber alignment tolerance (NC) and the wall angle of the chamber wall 42 caused by laser ablation providing a distance (c) between the top and bottom of the chamber wall. During laser ablation, the wall angle of the chamber wall typically ranges from about 6° to about 18°. Accordingly, the distance (a) must be greater than the nozzle to chamber alignment tolerance (NC) plus (c) according to the following inequality:

$$a>NC+c. \quad (2)$$

In order for the nozzles 22 of the nozzle plate 20 to be aligned to the ink ejection devices 30, the distance ($G_2$) between the ink ejection device 30 and the chamber wall 42 must be greater than the alignment tolerance (NA) between the chamber wall 62 and the ink ejection device 30 according to the following inequality:

$$a>NA+W_2/2-ED/2 \quad (3)$$

where $W_2$ is the width of the ink ejection device 30. The foregoing equations assume that the wall angle for the nozzle 22 is about 7° between the entrance and exit of the nozzle 22. For a center to center spacing $S_2$ between adjacent nozzles 22 of less than 600 dpi up to about 1200 dpi, the heater width $W_2$ preferably ranges from about 7 to about 15 microns.

Figure 7:
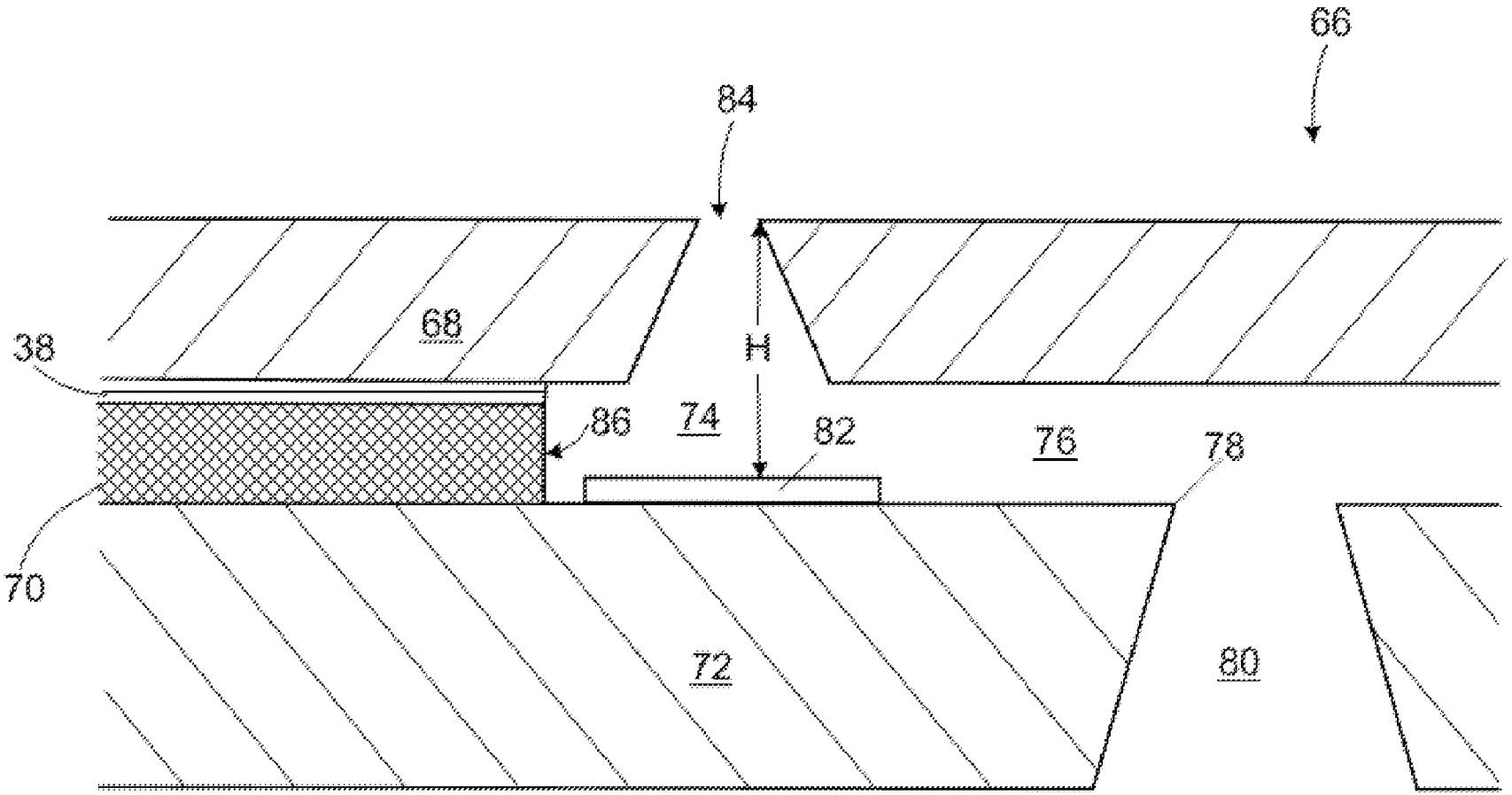
FIG. 7 is a cross-sectional view, not to scale of a portion of a printhead according to another embodiment of the invention.

In order to reduce the alignment tolerances and further decrease the nozzle to nozzle spacing, a printhead 66 according to another embodiment of the invention is illustrated in FIG. 7. In this embodiment, a nozzle plate 68 is formed separate from a thick film layer 70. The thick film layer 70 is preferably provided by a photoresist material that is spin coated or laminated to substrate 72. The thick film layer 70 has a thickness ranging from about 6 to about 30 microns and is preferably photodeveloped to provide ink chambers 74 and ink channels 76 therein. As described above, the substrate 72 includes an ink feed edge 78 that may be provided by an ink feed slot 80 provided in the substrate 72. Ink ejection devices 82 are formed on the substrate 72 and are aligned with a nozzle 84 provided in the nozzle plate 68. The nozzles 84 are preferably laser ablated in the nozzle plate 68 as described above.

In this embodiment, side wall 86 of the ink chamber 74 is formed with less of an angle than the side wall 42 of the laser ablated nozzle plate 20. Accordingly, the center to center spacing $S_2$ between adjacent nozzles 84 can be reduced and the following relationship can be used to determine the center to center spacing between adjacent nozzles 84:

$$S_2=W_2+(2\times G_2)+F_2 \quad (4)$$

since the effects of the laser ablated chamber wall 42 have been reduced or eliminated from the design. In this embodiment, the heater width $W_2$ may range from 5.5 to about 25 microns.

Figure 8:
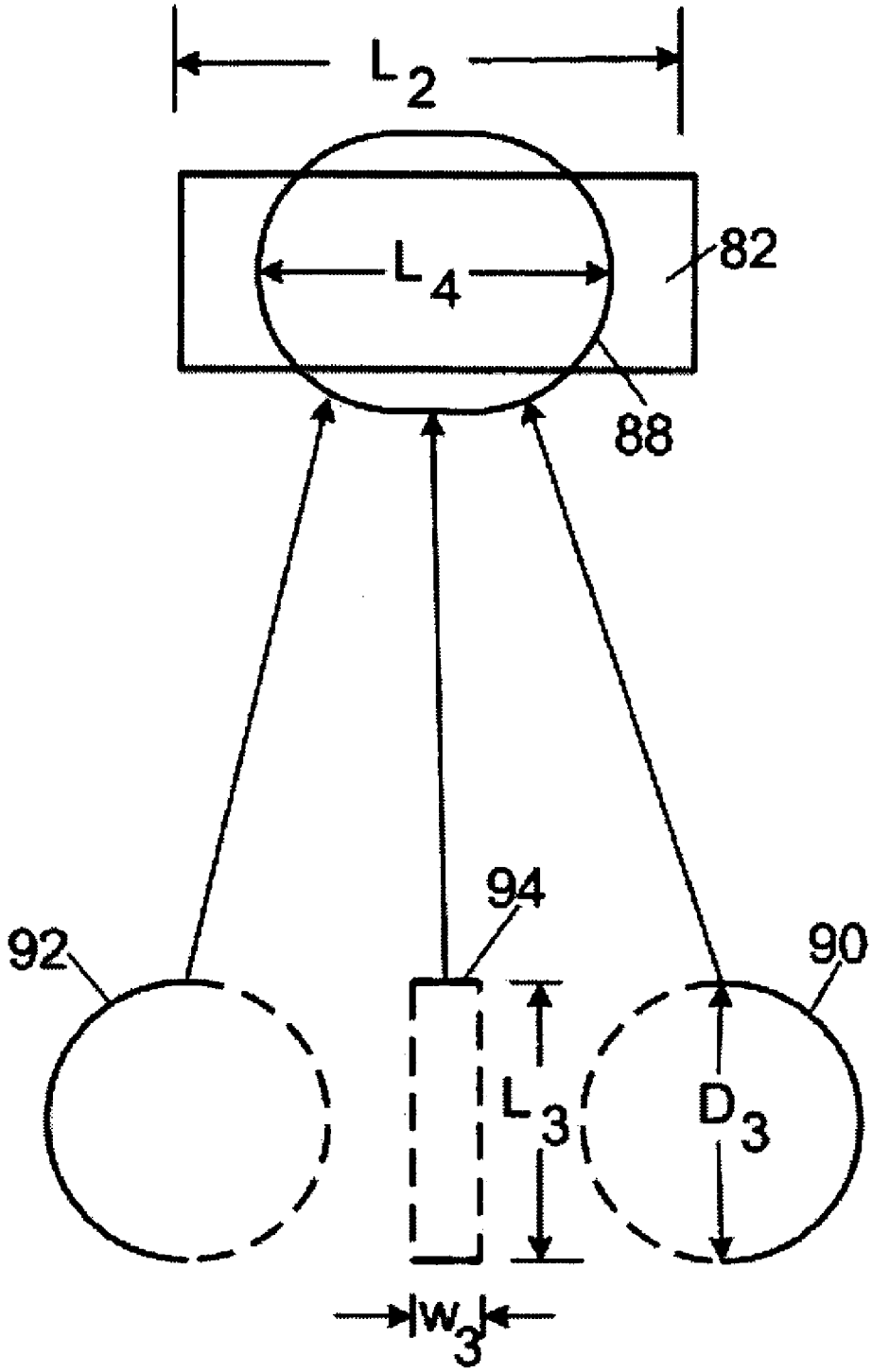
FIG. 8 is a schematic illustration of a nozzle hole entrance or exit according to an embodiment of the invention.

In order to provide a suitable ink ejection device 30 or 82, the aspect ratio ($L_2/W_2$) of the ejection device 30 or 82 preferably ranges from 1.5:1 to 6:1 as described above. Given this aspect ratio, the ink chamber 32 or 74 and the associated nozzle 22 or 84 preferably is adjusted to provide a suitable volume of ink ejected from the nozzle 22 or 84. A preferred nozzle design for embodiments of the invention is illustrated in FIG. 8 and comprises a substantially oblong nozzle. A preferred oblong nozzle 88 has an entrance and exit shape that is referred to herein as "bicircular." A bicircular nozzle 88 is composed of two semicircular segments 90 and 92 having a diameter $D_3$ and a rectangular segment 94 having a width $W_3$ and length $L_3$ equal to the diameter $D_3$. With respect to the exit dimensions of the nozzle 88, $D_3$ preferably ranges from about 5 to about 30 microns. The width $W_3$ preferably ranges from about 1 to about 25 microns, and $L_3$ has preferably the same dimension as $D_3$. The entrance dimensions of the nozzles 88 are similar to the exit dimensions of the nozzles 88, however the exit diameter $D_3$ is smaller than the corresponding entrance diameter, while the width $W_3$ is the same for the entrance and the exit of the nozzle 88. The long axis $L_4$ of the nozzle 88 is preferably aligned with the length $L_2$ of the ink ejection device 82. Long axis $L_4$ preferably ranges from about 10 to about 50 microns for the exit of the nozzle 88. It is preferred that the ratio of $W_3/D_3$ be greater than about 0.15. It is also preferred that the ratio of $L_4/D_3$ be greater than about 1.15.

The amount of ink discharged is also a function of the distance H from the surface of the ink ejection device 82 to exit of the nozzle 84 (FIG. 7). The distance H preferably ranges from about 25 to about 55 microns. Given the nozzle center to center spacing $S_2$, it is preferred that the spacing $S_2$ be less than the distance H. It is particularly preferred that the ratio of $S_2$/H be less than about 1.5 when $S_2$ is less than 42 microns.

While the foregoing embodiments have been described in terms of a nozzle plate or a nozzle plate and thick film layer, it will be appreciated that the ink chambers and ink channels may be formed exclusively in either the nozzle plate or thick film layer, or may be formed in both the nozzle plate and thick film layer. Formation of the ink chamber and ink channel in both the nozzle plate and thick film layer enables a greater degree of variation in the distance H to be achieved while providing suitable flow and ink ejection characteristics.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A printhead for an ink jet printer, the printhead comprising:

a semiconductor substrate containing at least one ink feed edge and a plurality of ink ejection actuators spaced a distance from the ink feed edge, each of the ink ejection actuators having an aspect ratio ranging from about 1.5:1 to about 6:1;

a thick film layer attached to the semiconductor substrate, the thick film layer having formed therein a plurality of ink feed chambers and ink feed channels corresponding to the plurality of ink ejection actuators; and a nozzle plate attached to the thick film layer, the nozzle plate containing a plurality of nozzle holes in the nozzle plate corresponding to the plurality of ink feed chambers, wherein adjacent ones of the nozzle holes are spaced apart with a pitch ranging from about 600 to about 2400 dpi and wherein the distance from the ink feed edge is substantially the same for each of the ink ejection actuators.

2. The printhead of claim 1, wherein the ink ejection actuators comprise heater resistors.

3. The printhead of claim 2, wherein the heater resistors have a width of less than or equal to 15 microns.

4. The printhead of claim 2, wherein the heater resistors have a resistance ranging from about 80 to about 200 ohms.

5. The printhead of claim 1, wherein the nozzle holes comprise oblong nozzle holes having a long axis to diameter ratio greater than about 1.15.

6. The printhead of claim 1, wherein the ink feed edge comprises an ink feed slot, and wherein the plurality of ink ejection actuators are disposed on both sides of the ink feed slot.

7. The printhead of claim 1, wherein the ink feed edge comprises an ink feed slot, and wherein the semiconductor substrate contains two or more ink feed slots.

8. The printhead of claim 7, wherein the plurality of ink ejection actuators are disposed only on one side of each of the ink feed slots.

9. The printhead of claim 1, wherein a distance from the ink ejection actuators to an exit of the nozzle holes is greater than the pitch.

10. The printhead of claim 1, wherein a ratio of the pitch to a distance from the ink ejection actuators to an exit of the nozzle holes ranges from about 0.5 to about 1.5.

11. An inkjet printer cartridge containing the printhead of claim 8.

12. A printhead for an ink jet printer comprising:

a semiconductor substrate containing at least one ink feed edge and a plurality of ink ejection actuators spaced a distance from the ink feed edge, each of the ink ejection actuators having an aspect ratio ranging from about 1.5:1 to about 6:1; and a nozzle plate attached to the semiconductor substrate, the nozzle plate containing a plurality of nozzle holes, ink chambers and ink channels laser ablated in the nozzle plate corresponding to the plurality of ink ejection actuators, wherein adjacent nozzle holes are spaced apart with a pitch ranging from about 600 to about 1200 dpi and wherein the distance from the ink feed edge is substantially the same for each of the ink ejection actuators.

13. The printhead of claim 12, wherein ejection actuators comprise heater resistors and the heater resistors have a resistance ranging from about 80 to about 200 ohms.

14. The printhead of claim 12, wherein the nozzle holes comprise bicircular nozzle holes.

15. The printhead of claim 12, wherein the ink feed edge comprises an ink feed slot, and wherein the plurality of ink ejection actuators are disposed on both sides of the ink feed slot.

16. The printhead of claim 12, wherein the ink feed edge comprises an ink feed slot, and wherein the semiconductor substrate contains two or more ink feed slots.

17. The printhead of claim 16, wherein the plurality of ink ejection actuators are disposed only on one side of each of the ink feed slots.

18. An ink jet printer cartridge containing the printhead of claim 15.

19. An ink jet printer cartridge containing the printhead of claim 16.

20. A printhead for a thermal ink jet printer, the printhead comprising:

a semiconductor substrate containing at least one ink feed edge and a plurality of heater resistors spaced a distance from the ink feed edge, each of the heater resistors having a resistance ranging from about 80 to about 200 ohms, and each of the heater resistors having an aspect ratio ranging from about 1.5:1 to about 6:1;

a thick film layer attached to the semiconductor substrate, the thick film layer having formed therein a plurality of ink feed chambers and ink feed channels corresponding to the plurality of ink ejection actuators; and a nozzle plate attached to the thick film layer, the nozzle plate containing a plurality of nozzle holes in the nozzle plate corresponding to the plurality of ink feed chambers, wherein adjacent nozzle holes are spaced apart with a pitch ranging from about 600 to about 2400 dpi and wherein the distance from the ink feed edge is substantially the same for each of the heater resistors.

21. The printhead of claim 20, wherein the ink feed edge comprises an ink feed slot, and wherein the plurality of heater resistors are disposed on both sides of the ink feed slot.

22. The printhead of claim 20, wherein the ink feed edge comprises an ink feed slot, and wherein the semiconductor substrate contains two or more ink feed slots.

23. The printhead of claim 22, wherein the plurality of heater resistors are disposed only on one side of each of the ink feed slots.

24. An inkjet printer cartridge containing the printhead of claim 20.

25. A printhead for a thermal inkjet printer, the printhead comprising:

a semiconductor substrate containing at least one ink feed edge and a plurality of heater resistors spaced a distance from the ink feed edge, each of the heater resistors having a resistance ranging from about 80 to about 200 ohms, and each of the heater resistors having an aspect ratio ranging from about 1.5:1 to about 6:1;

a nozzle plate attached to the semiconductor substrate, the nozzle plate containing a plurality of nozzle holes, ink chambers and ink channels laser ablated in the nozzle plate corresponding to the plurality of ink ejection actuators, wherein adjacent nozzle holes are spaced apart with a pitch ranging from about 600 to about 1200 dpi and wherein the distance from the ink feed edge is substantially the same for each of the heater resistors.

26. The printhead of claim 25, wherein the feed edge comprisises an ink feed slot, and wherein the plurality of heater resistors are disposed on both sides of the ind feed slot.

27. The printhead of claim 25, wherein the ink feed edge comprises an ink feed slot, and wherein the semiconductor substrate contains two or more ink feed slots.

28. The printhead of claim 27, wherein the plurality of heater resistors are disposed only on one side of the ink feed slot.

29. An ink jet printer cartridge containing the printhead of claim 25.

* * * * *